United States Patent [19]

Fatkin

[11] Patent Number: 4,574,983

[45] Date of Patent: Mar. 11, 1986

[54] ACCUMULATOR DEVICE FOR A COLLAPSIBLE TUBE DISPENSER

[76] Inventor: Harry W. Fatkin, 113 Poplar Ave., Westville, N.J. 08093

[21] Appl. No.: 613,910

[22] Filed: May 25, 1984

[51] Int. Cl.[4] ..... B67B 7/00

[52] U.S. Cl. ..... 222/1; 222/95; 24/30.5 R

[58] Field of Search ..... 222/92, 95, 103, 99, 222/107, 1; 383/68, 70, 89, 91; 24/30.5 R, 71.3

[56] References Cited

U.S. PATENT DOCUMENTS

| | | | |
|---|---|---|---|
| 1,079,527 | 11/1913 | Wallace | 24/30.5 R |
| 1,618,384 | 2/1927 | Mollis | 222/99 |
| 2,083,603 | 6/1937 | Harwick | 222/95 |
| 3,248,012 | 4/1966 | Adams | 222/95 |
| 4,414,717 | 11/1983 | Payne | 383/91 |
| 4,417,371 | 11/1983 | Kronenberg | 24/30.5 R |

FOREIGN PATENT DOCUMENTS

| | | | |
|---|---|---|---|
| 1180784 | 6/1959 | France | 24/30.5 R |
| 535394 | 11/1955 | Italy | 222/103 |
| 12298 | of 1912 | United Kingdom | 24/30.5 R |
| 240590 | 10/1925 | United Kingdom | 222/99 |

*Primary Examiner*—F. J. Bartuska
*Assistant Examiner*—Kenneth Noland
*Attorney, Agent, or Firm*—Thomas A. Lennox

[57] ABSTRACT

An accumulator device to be threaded over a closed end of a partially emptied collapsible tube dispenser, such as a toothpaste tube. The device includes a flat body member and at least two slots through the member the slots being positioned parallel to each other wherein the flattened portion of the partially emptied tube is pulled through one slot and against the edge of the slot to push the material in the tube to the openable end and then inserting the closed end through the other slot and pulling up the slack to form a reverse bend trapping the material remaining in the tube.

2 Claims, 7 Drawing Figures

ACCUMULATOR DEVICE FOR A COLLAPSIBLE TUBE DISPENSER

BACKGROUND OF THE INVENTION

This invention relates an accumulator device to be threaded over the partially dispensed closed end of a collapsible tube with a closable opening at the opposite end. The collapsible tube is best illustrated by the common tooth paste tube although many materials are stored and dispensed from such containers.

Collapsible cylindrical tubes with an openable closure at one end and sealed at the other end have long been a popular packaging device for thickened paste and doughlike materials which are a high viscosity. When these collapsible tubes were constructed of metal with little or no memory, efficient use of the tube presented fewer problems. As the tube was partially emptied, the closed end of the tube could be flatten and folded over on itself to at least partially prevent the paste from squeezing back toward the closed end when the packed portion of the tube is squeezed. However, for highly viscous rubberized compounds most of the pressure on the packed portion of the tube goes to a reopening the tube and forcing the viscous compound back into the emptied portion of the tube toward the closed end. In addition, the use of polymer plastic tubes with a memory and limited "creasing" ability along the edges of the tube makes clean emptying of the tube nearly impossible. The slide adapters described by D. R. Adams in the U.S. Pat. No. 3,248,012 are proposed to slide over the collapsible tube and flatten out the emptied portion as the contents are squeezed out. An object of the Adams device was to seal off the flattened portion of the tube, but the adapter tends to merely slide back along the empty portion of the tube when the packed portion of the tube is squeezed. Such devices are particularly ineffective with the highly viscous rubberized compounds which offer substantial back pressure tending to reopen the flattened tube.

The prior art devices do not satisfy the above needs nor attain the objects listed herein below.

SUMMARY OF THE INVENTION

It is an object of this invention to provide an accumulator device which will allow the accumulation of paste or other viscous material in a collapsible tube dispenser and essentially prevent the paste from reentering the flattened and emptied portion of the tube.

It is a further object of this invention to provide a device that allows removal of essentially all of the material in a collapsible tube dispenser out through the open end.

It is an additional object of this invention to provide a device which will allow accumulation of the viscous material inside of a partially emptied collapsible tube dispenser, preventing the material in the tube from reentering the collapsed portion of the tube and further being used to apply and distribute high pressure to the still filled portion of the tube.

It is an additional object of this invention to provide an accumulator device which will prevent highly viscous rubberized materials from reentering the flattened portion of a partially dispensed collapsible tube.

It is an additional object of this invention to provide a device which will allow neat and compact storing of the flattened and emptied portion of a collapsible tube dispenser.

It is a further object of this invention to provide an accumulator device to allow accumulation of the material in a collapsible tube dispenser and essentially prevent the material from reentering the flattened portion of the tube and that the accumulator device may be fitted over the end of the closed tube after a portion of the contents are dispensed.

It is a particular object of this invention to provide an accumulator device to push the contents of the collapsed tube toward the open end and yet easily fit over the closed end.

It is an additional object of this invention to enhance the product in a collapsible tube dispenser by demonstrating that you can get all of the goodness from the material in the tube providing for savings, satisfaction and promotion of the product.

It is an additional object of this invention to provide an accumulator device to allow accumulation and holding of all of the remaining material in a collapsible tube wherein the device will essentially fit into the box or container in which the tube is supplied and yet provide space on which directions, advertising, or the like may be imprinted.

It is a particular object of this invention to provide an accumulator device which essentially seals off the flattened portion of a resilient tube dispenser and provides means for increase of and dispersal of pressure on the packed portion of the tube containing the remaining material to inject it in a constant long bead of material.

This invention is an accumulator device to be slid over a closed end of a partially emptied collapsible tube dispenser with an openable end capable of reclosure, such as a threaded end with a screw cap. The device includes a body member, preferrably a flat plate, having sufficient structural strength to resist the stresses that will be imparted as below. There is at least two slots in the body member both opening entirely through the member and positioned parallel to each other. The size of the slots, width and length, are sufficient to allow insertion of the closed end of the tube, now flattened as the material in the tube has been partially dispensed. The distance between the two slots is sufficient to allow the closed end of the tube to be pulled through one slot and inserted back through the second slot even through there is little or no material dispensed from the tube. The distance between the two slots is also close enough to obtain the important reverse bend of the flattened tube.

Thus, except for structural strength, the distance between the two slots can not be too close. The reverse bend prevents the accumulated material in the tube from squeezing back into the flattened end of the tube and prevents entrapment of air in the tube which causes "sputtering" when the material is dispensed from the tube. It is preferred that the two slots be about one-eighth to five-eighths inch apart and more preferably in the range of about one-eighth inch to about three-eighths inch apart and more preferably about one-fourth of an inch apart. As will be evident from the method described herein below, the width of each slot need not be a press or tight fit over the tube. The width of each slot must be sufficient to allow the flattened end of the tube to be inserted through the slot and it may slide easily through since accumulation and more importantly sealing off the flattened end of the tube is not accomplished by the width of the slot, but rather the reverse bend of the flattened tube. The width of the slot will vary with the thickness of the body member. The thicker the body member, the wider the slot may be in order to achieve the same "wiping effect" of pushing the material in the tube toward the cap end of the dispenser. Thus, the width of the slot should be a free fit over the closed-collapsed end of the tube. The width of the slot is sufficient to receive the collapsed end of the tube and is preferably about one-fourth of an inch to about one-half of an inch longer than the width of the flattened end of the tube. However, there is little disadvantage to having excess length of slots for the width of the tube. The thickness of the body member will depend upon the flexural strength of the material used to construct the body. Although strength is required, it may flex under stress. The body member should be sufficient to resist breakage when the tube is pulled hard against the slot to empty the tube. One of the advantages of this device is that after the reverse bend is accomplished and the material is trapped in the openable end of the tube, the plate may be folded back over and pressed downwardly into the packed end of the tube to obtain additional pressure and a continuous distributed force against the material in the tube.

The invention also includes a method of accumulation and dispensing of a thickened flowable material from a collapsible tube container with a closed end and an open end with a closure over the open end. The method includes threading the closed end of the partially dispensed collapsible tube through a slot in a flat body member having a first surface adjacent the open end of the tube and a second surface adjacent to the closed end of the tube. The method further includes pulling on the closed end at an angle against an edge of the slot. This direction of pull is generally toward the second surface of the flat body member, thus squeezing and wiping essentially all of the material toward the open end of the tube container. As the closed end of the tube is pulled through the first slot, it is pulled toward a second slot in the body member through which the flattened closed end of the tube is threaded. Lastly, the closed end of the tube is pulled through the second slot taking up essentially all of the slack of the tube between the two slots and forming a reverse bend in the flattened tube. It is preferred that the method further include pressing on the first surface of the body member folding the body member back on the still full portion of the tube, and pressing the body member of the full portion of the tube. This obtains substantial leverage, force distribution, and squeezing capability to aid in the dispensing of material from the tube.

BRIEF DESCRIPTIONS OF DRAWINGS

DESCRIPTION OF PREFERRED EMBODIMENTS

Figure 1:
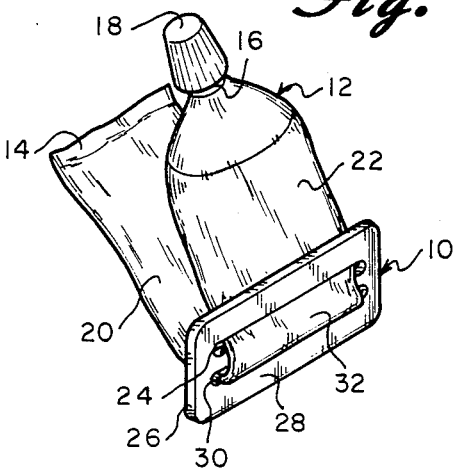
FIG. 1 is a perspective view illustrating a collapsible tube dispenser threaded into an accumulator device of this invention.
Figure 2:
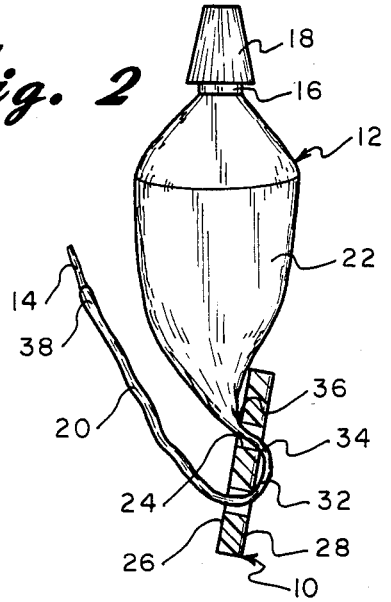
FIG. 2 is a partially-cross sectional view of the tube and accumulator device in FIG. 1.

In FIG. 1, accumulator device 10 is shown fitted over and threaded on tube 12 which has closed end 14 and open end 16 closed with screw cap 18. As pictured, flattened and emptied portion 20 of tube 12 has been squeezed and flattened, essentially removing all of the contents of the tube through open end 16. The balance of the material in the tube is now packed in full portion 22 ready to be dispensed from the tube container 12. Closed end 14 has been inserted into slot 24 from first surface 26, here essentially hidden. After closed end 14 is inserted through slot 24, and flattened portion 20 is pulled through the slot toward second surface 28, and closed end 14 is reinserted into slot 30. Actually, the two slots are used in two separate steps. After closed end 14 is inserted through slot 24, it is pulled strongly downwardly at an angle away from slot 24 and toward surface 28, thus, essentially wiping all of the material inside the tube toward full portion 22. When flattened portion 20 has been emptied, closed end 14 is inserted in slot 30 and pulled away from surface 26 to pull up essentially all of the slack forming reverse bend 32 of flattened portion 20. As illustrated in FIG. 2, when end 14 has been inserted through slot 24 and pulled downwardly and toward surface 28, lower edge corners 34 and upper edge corner 36 essentially squeezes all of the material into full portion 22 of tube 12. When bend 32 is pulled tight, the material in thick portion 22 is essentially trapped no matter how much pressure is placed on the outside of the tube to dispense the material. Typically, flattened portion of a collapsible tube dispenser may range in thickness of about 1/32 second of an inch to about 1/16 of an inch. Further, the slightly expanded portion 38 of flattened portion 20 just above the crimped or heat sealed closed end 14 tends to be slightly thicker so that slots 24 and 30 are preferably about $\frac{1}{8}$ wide and more preferably about 7/64 inch to about 9/64 inch wide. The widths of closed end 14 and flattened portion 20 vary considerably as to the size of the tube and are typically about one inch to two inches wide. It is preferred that slots 24 and 30 be about one-half inch longer than the width of the flattened tube. The spacing between slots 24 and 30 must be close enough to provide an effective reverse bend and allow drawing down of slack 32 and yet wide enough to provide sufficient structural strength as pressure is applied to the device. It is preferred that the distance between the slots be about one-fourth inch with a preferred range of about $\frac{1}{8}$ inch to about $\frac{3}{8}$ inch.

Figure 3:
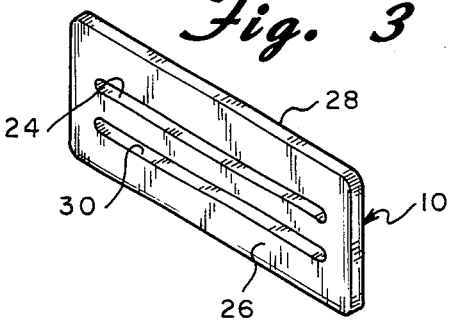
FIG. 3 is a perspective view of the accumulator device illustrated in FIGS. 1 and 2.

In FIG. 3, the accumulator device 10 is illustrated constructed of 7/64 inch thick high impact polystyrene polymer of a size three inches long about one and $\frac{1}{4}$ inches wide. It should be understood that the material from which accumulator device 10 is constructed may vary considerably and includes compressed cardboard, wood, metal, such as alluminum or steel, and polymeric plastics including high impact styrene, styrene copolymers such as acrylanitrile butadiene styrene copolymers, acrylic polymers, including polymethyl methacrylate, and various copolymers including high impact acrylic copolymers, polycarbonate, nylon and other structural plastics, polypropylene and high density polyethylene and the like. Although the material may be transparent or translucent, it is preferred that the material be opaque so that messages inprinted on or molded into the surface of device 10 can be easily read and viewed. The device may be most easily produced by injection molding of a thermoplastic polymeric molding powder. Slots 24 and 30 are each $\frac{1}{8}$ inch wide and about $2\frac{1}{4}$ inches long. Slots 24 and 30 are spaced apart about $\frac{1}{4}$ inch so that the lower edge of slot 24 is $\frac{1}{4}$ inch away from the upper edge of slot 30.

Figure 4:
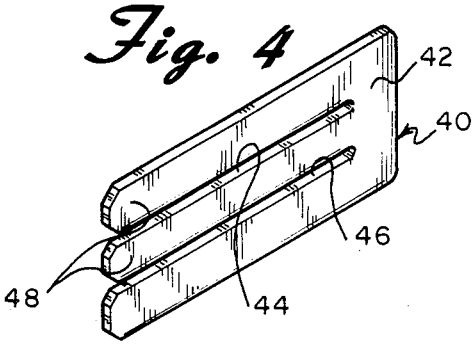
FIG. 4 is a perspective view of another accumulator device of the invention.

A second embodiment, accumulator device 40 is illustrated in FIG. 4 constructed of 1/16 inch aluminum sheet having closed end 42 for slots 44 and 46 with both slots opening to end 48. Slots 44 and 46 are about 2 inches long and the distance between each slot is about $\frac{1}{8}$ inch.

Figure 5:
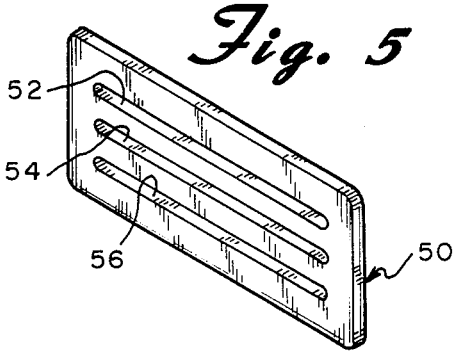
FIG. 5 is a perspective view of another embodiment of the present invention using three slots.

In FIG. 5, an accumulator device 50 is illustrated having three slots 52, 54, and 56, each about 3/32 inch wide and spaced apart about 3/16 of an inch. Accumulator 50 is constructed of a highly compressed and bound paper fiber board about 3/16 inch thick. Although the above accumulator devices are illustrated with little extra unused material on the accumulator devices, the sides may be increased so as to allow space for advertisment, pictures or logos of the supplier.

Figure 6:
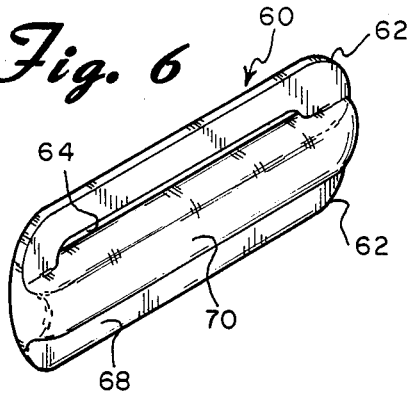
FIG. 6 is a perspective view of a final illustrated embodiment of the invention.
Figure 7:
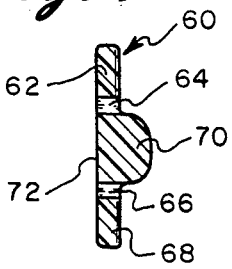
FIG. 7 is a vertical cross sectional view of the accumulator device illustrated in FIG. 6.

In FIG. 6, an accumulator device 60 is illustrated as further described in the vertical cross sectional view of FIG. 7. In the embodiment, flat body member 62 extends the full length and width through which slots 64 and 66 are molded. On second surface 68 between the two slots is raised rounded shoulder 70. In this embodiment, closed end 14 of tube 12 is inserted from first surface 72 through slot 64 and flattened portion 20 is pulled downwardly over rounded shoulder 70. Once the material has been squeezed into full portion 22, end 14 is inserted from second surface 68 through slot 66 and the slack pulled out by pulling end 14 away from first surface 72 to form the reverse bend.

While this invention has been described with reference to the specific embodiments disclosed herein, it is not confined to the details set forth and the patent is intended to include modifications and changes which may come within and extend from the following claims.

I claim:

1. A method of accumulation and dispensing thickened flowable material from a collapsible tube with a closed end from an openable end with a closure over the open end comprising:

(a) threading the closed end of the partially dispensed collapsible tube through a slot in a body member having a first surface adjacent the open end of the tube and a second surface adjacent the closed end of the tube, (b) pulling on the closed end at an angle away from the slot and against an edge of the slot and directing the closed end toward a second slot in the body member, (c) threading the closed end of the tube into the second slot, (d) pulling the closed end to take up all the slack of the tube between the two slots and form a reverse bend in the tube, and (e) folding the body member back on the full portion of the tube and pressing the body member on the full portion of the tube to aid in dispensing the material from the tube.

2. The method of claim 1 further comprising threading the flattened end of the tube into a third slot in the body member reducing the apparent length of the tube.

* * * * *